United States Patent [19]

Krol

[11] 3,981,615

[45] Sept. 21, 1976

[54] CONTINUOUS CONNECTION DEVICE FOR THE MOBILE BLADES OF A TURBO-MACHINE

[75] Inventor: Salomon Krol, Belfort, France

[73] Assignee: Groupe Europeen pour la Technique des Turbines a Vapeur G.E.T.T., Paris, France

[22] Filed: Nov. 3, 1975

[21] Appl. No.: 628,696

[30] Foreign Application Priority Data

Nov. 14, 1974 France ..... 74.37586

[52] U.S. Cl. ..... 416/190; 416/191; 416/196

[51] Int. Cl.[2] ..... F01D 5/22

[58] Field of Search ..... 416/189–191, 416/195, 196

[56] References Cited

UNITED STATES PATENTS

| | | | |
|---|---|---|---|
| 835,471 | 11/1906 | Rotter | 416/191 X |
| 1,165,005 | 12/1915 | Herr | 416/191 |
| 1,304,793 | 5/1919 | Moore | 416/191 |
| 1,423,466 | 7/1922 | Snyder | 416/191 |
| 1,639,247 | 8/1927 | Zoelly et al. | 416/190 |
| 2,220,918 | 11/1940 | Smith | 416/191 |
| 2,315,611 | 4/1943 | Franck | 416/191 |
| 2,430,140 | 11/1947 | Phelan et al. | 416/191 X |
| 3,377,050 | 4/1968 | Guy | 416/191 |

FOREIGN PATENTS OR APPLICATIONS

| | | | |
|---|---|---|---|
| 873,151 | 6/1971 | Canada | 416/191 |
| 1,340,331 | 9/1963 | France | 416/191 |
| 869,335 | 5/1961 | United Kingdom | 416/196 |

*Primary Examiner*—Everette A. Powell, Jr.
*Attorney, Agent, or Firm*—Sughrue, Rothwell, Mion, Zinn and Macpeak

[57] ABSTRACT

Continuous connection device for the mobile turbine blades of a turbo-machine, characterized in that the caps of the turbine blades comprise recesses accomodating clamping blades whose ends press against the neighbouring caps, becoming deformed elastically. The invention applies more particularly to elastic fluid turbines.

4 Claims, 5 Drawing Figures

CONTINUOUS CONNECTION DEVICE FOR THE MOBILE BLADES OF A TURBO-MACHINE

BACKGROUND OF THE INVENTION

1. Field of the Invention

The invention concerns the connection of the mobile blades of a turbo-machine such as an elastic fluid turbine or a turbo-compressor.

2. Description of the Prior Art

It is known that an isolated turbine blade of a turbo-machine has natural frequencies, inherent to the vibratory mode to which it can be subjected: tangential bending, axial bending or torsion. If a certain number of turbine blades are connected together in a group, by binding, for example, the reaction of the turbine blades becomes even more complex, each vibratory case comprising as many inherent frequencies as there are turbine blades in a group. Due to the great number of these inherent frequencies, it is very difficult to avoid resonance with periodic excitation forces.

On the other hand, the continuous joining of all the turbine blades of a wheel leads to a totally different reaction. Indeed, as the coupled vibrations of all the turbine blades are the only ones possible, the excitation forces must be in phase with the vibration mode all along the periphery of the wheel for a transfer of energy to the turbine blades to be possible. This way of connecting the turbine blades is particularly interesting for the adjusting stage of a turbine whose mobile turbine blades are excited by periodic forces which are set up by segments of turbine blades of the first guide turbine blade and whose frequencies are multiples of the rotation frequency.

For a long time, connections of the turbine blades were made by providing each of these latter with a cap integral with the turbine blade, which could be machined in the same part as the turbine blade or fitted onto the latter, by welding or rivetting, for example and by installing the turbine blades on the wheel of the turbo-machine, the caps being clamped against each other.

But the maintaining of the clamping during normal operation and during transitory operation rates entails flexibility of the set of caps borne by the turbine blades and clamped against each other, this not always being easy to produce, more particularly for the turbine blades of the first stage of a turbine, which are generally short and have a high moment of inertia.

It has been found, according to the present invention, that it was possible, in an arrangement of turbine blade caps clamped against each other, to leave the flexible clamping function of the set of blade caps to distinct elements and thus to ensure permanent connection of the turbine blades whatever the operation rate of the turbo-machine may be.

For that purpose, the invention provides for at least one turbine blade cap in two to comprise at least one recess in which is inserted a flexible clamping blade which can be elastically deformed therein and having at least one free end which overlaps from the turbine blade cap in a tangential direction and presses against the cap of a neighbouring turbine blade, causing an elastic deformation of the said clamping blade.

The flexible clamping blade can, to great advantage, be rigidly held in the said recess over a portion of its length.

That clamping blade can more particularly be a blade which is curved clamping in its middle where it is held in the said recess, whereas each of the ends presses respectively on the cap of one or the other of the neighbouring blades.

More particularly, the curved blade can have, in a longitudinal cross-section, a convex shaped side in the shape of a segment of a curve pressing or not pressing on a side having the same shape on the said recess, whereas on the concave side of the curved clamping blade and beyond the middle of the latter, where it is exactly fitted in the recess, a clearance increasing from the middle towards the ends is provided between the curved clamping blade and its recess. That clearance can be obtained by imparting to the recess the shape of a curved segment having an even width and, to the concave side of the clamping blade, a smaller curve than that of the convex side of the recess. Thus, it is possible to obtain a clamping blade having a cross-section which decreases towards the ends, having approximately a shape with even strength, in order to increase, contingently, the flexibility of the clamping blade. A clamping blade having a constant width can also be provided and the shape imparted to the recess can be such that its curve on the convex side of the recess be greater than the curve on the concave side of the clamping blade.

The clamping blades are, to great advantage, constituted by an alloy having a high coefficient of expansion.

The clamping blade is held in the recess in the radial direction, that recess being either closed by a lid or having, like the clamping blade which it contains, a cross-section which narrows towards the radial periphery, for example an inverted T-shaped or swallow-tail shaped cross-section.

For the contacts established by centrifugal force between the clamping blade and the recess not to hinder the movement of the clamping blade, arrangements can be made for the blade to bear radially on the outside edges of the recess only in the middle part and for a radial clearance to be provided at the ends of the clamping blade.

Examples having no limiting character for implementing the invention will be described with reference to the accompanying diagrammatic figures.

DESCRIPTION OF PREFERRED EMBODIMENTS

Figure 1:
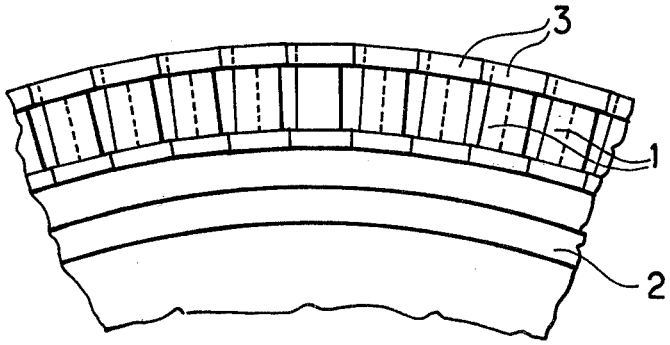
FIG. 1 is a front view of a portion of a turbine wheel.

In FIG. 1, a turbine wheel comprises a set of turbine blades 1 installed on a hub 2. Each of these turbine blades bears a cap 3. The caps 3 are clamped against each other when the turbine blades are installed on the hub.

Figure 2:
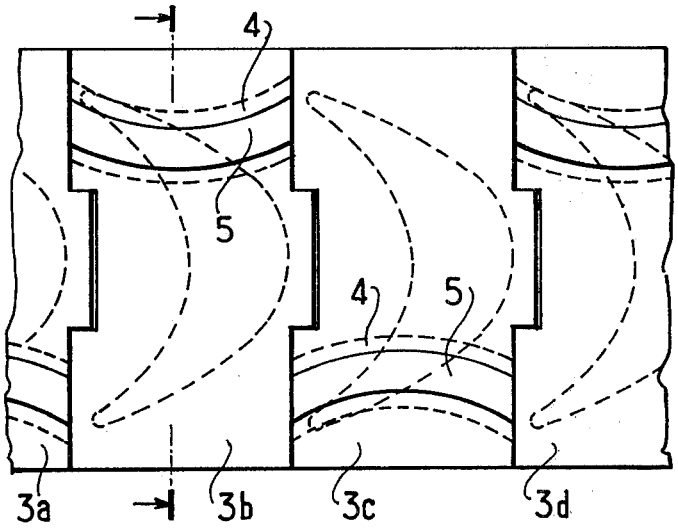
FIG. 2 is on a larger scale, a top view of a portion of wheel of that type.
Figure 3:
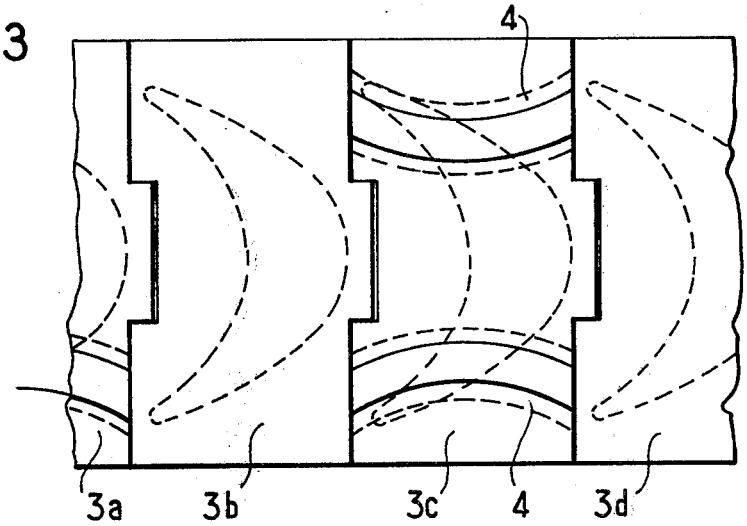
FIG. 3 is a similar view to that in FIG. 2 in the case of a variant embodiment.
Figure 4:
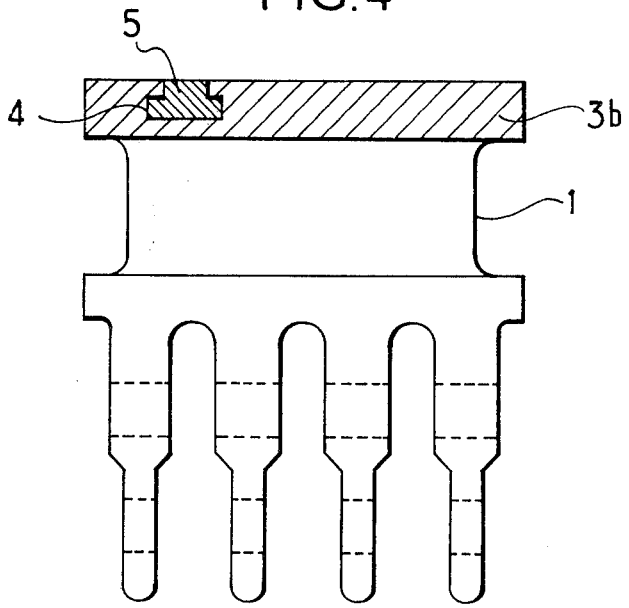
FIG. 4 is a partial cross-sectional view of a turbine blade in a plane passing through the axis of the wheel which bears it.

FIGS. 2 and 3 show, partly, for the first and last cap, four successive caps 3a, 3b, 3c, 3d with, in a discontinuous line, the body of the corresponding turbine blade. The assembling between successive caps ensures the indeformability of the ring constituted by the assembly formed by these caps in the axial direction. In the case of FIG. 2, each cap comprises a recess 4, the recesses of the successive caps being arranged in a staggered configuration; in the case of FIG. 3, one cap in two comprises two recesses 4. These recesses 4 have an inverted T-shaped cross-section as will be seen in FIG. 4, which corresponds to a clamping blade having a cap according to FIG. 2 and is in the general shape of segments. Each recess 4 accomodates a clamping blade 5 also having an inverted T-shaped cross-section and being in the general shape of a segment.

Figure 5:
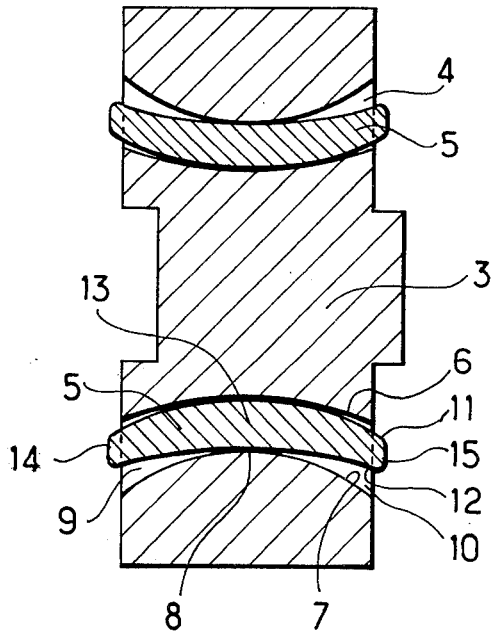
FIG. 5 is a longitudinal cross-section of a turbine blade cap.

FIG. 5, which corresponds to a cap according to the example, in FIG. 3, makes it possible to see in what manner a clamping blade 5 can be arranged in a recess 4. The recess 4 is comprised, in a cross-section, between two arcs of circles 6 and 7, having different radii, concentric or otherwise, so that the cross-section of the recess is narrow in the central portion 8 and widens towards the ends 9, 10. The clamping blade 5 is also comprised, in a cross-section, between two arcs of circles 11, 12, having different radii, concentric or otherwise, so that its cross-section is thicker in the central region 13, where it is clamped in the recess 4 only towards the ends 14, 15 where it can be deformed in that recess 4.

The clamping blades 5 are sufficiently deformed on assembly to compensate the play which may be produced during operation between the caps of the successive turbine blades under the effect of centrifugal force and of possible differences in temperature between the rim and the turbine blades.

That clamping of the turbine blade, which is not indispensable in the staggered configuration according to FIG. 2, is nevertheless an advantage even in that case. The holding of the clamping blade in the recess could also be obtained by keying or cottering.

I claim:

1. In a continuous connection arrangement for the mobile turbine blades of the wheel of a turbo-machine in which each turbine blade is provided with a cap which is integral with it and the turbine blades are installed on the wheel with the caps clamped against each other, the improvement wherein at least one turbine blade cap in two comprises at least one recess in which is inserted a flexible clamping blade which may be elastically deformed therein, said clamping blade having at least one free end which overlaps from the blade cap in a tangential direction and presses against the cap of a neighboring turbine blade, causing an elastic deformation of said clamping blade.

2. The connection arrangement according to claim 1, wherein said clamping blade is rigidly held in said recess over a portion of its length.

3. The connection arrangement according to claim 2, wherein said clamping blade is a blade which is curved in its middle and held thereby in said recess and wherein each of the ends of said clamping blade presses respectively on the cap of one of the neighbouring turbine blades.

4. The connection arrangement according to claim 3, wherein the curved clamping blade has in longitudinal cross-section, the shape of a curved segment exactly fitted in its middle in said recess and wherein a clearance increasing from the middle towards the ends is provided between the curved clamping blade and its recess.

* * * * *